US011640804B2

(12) United States Patent
Hai

(10) Patent No.: US 11,640,804 B2
(45) Date of Patent: May 2, 2023

(54) CHROMATICITY ADJUSTMENT METHOD, CHROMATICITY ADJUSTMENT DEVICE, AND DISPLAY PANEL

(71) Applicant: Shenzhen China Star Optoelectronics Semiconductor Display Technology Co., Ltd., Guangdong (CN)

(72) Inventor: Bo Hai, Guangdong (CN)

(73) Assignee: Shenzhen China Star Optoelectronics Semiconductor Display Techoology Co., Ltd., Shenzhen (CN)

( * ) Notice: Subject to any disclaimer, the term of this patent is extended or adjusted under 35 U.S.C. 154(b) by 360 days.

(21) Appl. No.: 17/056,431

(22) PCT Filed: Sep. 14, 2020

(86) PCT No.: PCT/CN2020/115030
§ 371 (c)(1),
(2) Date: Nov. 18, 2020

(87) PCT Pub. No.: WO2022/041336
PCT Pub. Date: Mar. 3, 2022

(65) Prior Publication Data

US 2022/0310027 A1 Sep. 29, 2022

(30) Foreign Application Priority Data

Aug. 28, 2020 (CN) ..... 202010882415.1

(51) Int. Cl.
*G09G 3/36* (2006.01)

(52) U.S. Cl.
CPC ..... *G09G 3/3607* (2013.01); *G09G 3/3614* (2013.01); *G09G 2320/0271* (2013.01); *G09G 2320/0666* (2013.01)

(58) Field of Classification Search
CPC .... G09G 3/3607; G09G 3/3614; G09G 3/006; G09G 3/36; G09G 2300/0469;
(Continued)

(56) References Cited

U.S. PATENT DOCUMENTS 6,661,484 B1 * 12/2003 Iwai ..... G02F 1/133514 349/181
2002/0012084 A1 * 1/2002 Yoon ..... G02F 1/134336 349/108
(Continued)

FOREIGN PATENT DOCUMENTS

CN 1892321 1/2007
CN 1982953 6/2007
(Continued)

*Primary Examiner* — David Tung

(57) ABSTRACT

The present invention provides a chromaticity adjustment method, a chromaticity adjustment device, and a display panel. The chromaticity adjustment method makes a chromaticity of a white image conform to a target value by adjusting a thickness of a liquid crystal layer corresponding to blue pixels. Therefore, a chromaticity deviation in the display panel can be relieved. In addition, after adjusting a thickness of a blue photoresist layer, an adjustment range of a gray scale of blue sub-pixels (B) can be reduced. While improving the chromaticity, an impact on light transmittance rate can also be reduced, and color interference can be prevented.

14 Claims, 4 Drawing Sheets

(58) Field of Classification Search
CPC ... G09G 2300/0242; G09G 2320/0271; G09G 2320/0666
See application file for complete search history.

(56) References Cited

U.S. PATENT DOCUMENTS

2004/0189925 A1* 9/2004 Ohmuro ..... G02F 1/133707 349/144
2005/0207669 A1* 9/2005 Kameyama ..... G06T 5/50 382/168
2006/0082704 A1 4/2006 Chu et al.
2006/0103785 A1* 5/2006 Yamada ..... G02F 1/13394 349/107
2007/0076144 A1* 4/2007 Okita ..... G02F 1/1395 349/107
2009/0153593 A1* 6/2009 Lee ..... G09G 3/3696 345/690
2009/0268133 A1* 10/2009 Yoshimi ..... G02F 1/133371 349/107
2011/0187705 A1* 8/2011 Lan ..... G06F 3/038 345/419
2011/0279745 A1* 11/2011 Yamamoto ..... G02F 1/133753 349/33
2012/0044427 A1* 2/2012 Irie ..... G09G 3/3607 348/731
2012/0236042 A1* 9/2012 Parmar ..... G09G 3/3466 345/690
2014/0218411 A1* 8/2014 Chen ..... G09G 3/3611 345/88
2015/0138260 A1* 5/2015 Yamakawa ..... G09G 3/36 345/694

FOREIGN PATENT DOCUMENTS

| | | |
|---|---|---|
| CN | 101029988 | 9/2007 |
| CN | 101917633 | 12/2010 |
| CN | 109061921 | 12/2018 |
| CN | 109473077 | 3/2019 |
| CN | 109935219 | 6/2019 |
| JP | 2003-241214 | 8/2003 |
| JP | 2007-094029 | 4/2007 |
| JP | 2008-256803 | 10/2008 |
| KR | 10-2006-0114093 | 11/2006 |
| TW | 200424687 | 11/2004 |
| TW | 200516310 | 5/2005 |

* cited by examiner

CHROMATICITY ADJUSTMENT METHOD, CHROMATICITY ADJUSTMENT DEVICE, AND DISPLAY PANEL

RELATED APPLICATIONS

This application is a National Phase of PCT Patent Application No. PCT/CN2020/115030 having International filing date of Sep. 14, 2020, which claims the benefit of priority of Chinese Patent Application No. 202010882415.1 filed on Aug. 28, 2020. The contents of the above applications are all incorporated by reference as if fully set forth herein in their entirety.

FIELD AND BACKGROUND OF THE INVENTION

The present invention relates to the field of display technology, in particular, to a chromaticity adjustment method, a chromaticity adjustment device, and a display panel.

When displayed on a liquid crystal display (LCD) panel, 255-level color dots of a white image may appear bluish and thus need an improvement. In a case of not changing a liquid crystal layer, the color dots are generally turned yellow by degrading a liquid crystal layer corresponding to blue pixels. However, if the liquid crystal layer corresponding to the blue pixels is degraded too much, various problems such as transmittance rate (Tr) reduction and color interference will occur. Therefore, it is necessary to provide a method for improving chromaticity, so as to solve the problem that the color dots in the white image are bluish.

SUMMARY OF THE INVENTION

The present invention provides a chromaticity adjustment method, a chromaticity adjustment device, and a display panel, which can effectively adjust the chromaticity value and solve the color deviation of the color dots.

The present invention provides a chromaticity adjustment method, comprising steps of:

obtaining a chromaticity of a white image of a display panel;

determining whether the chromaticity of the white image deviates from a target value;

adjusting a thickness of a liquid crystal layer corresponding to blue pixels if the chromaticity of the white image deviates from the target value; and making the chromaticity of the white image conform to the target value by adjusting the thickness of the liquid crystal layer corresponding to the blue pixels.

In some embodiments, the step of determining whether the chromaticity of the white image deviates from the target value comprises:

comparing the chromaticity of the white image with the target value; and determining whether the chromaticity of the white image is greater than or less than the target value, wherein the chromaticity of the white image is bluish if the chromaticity of the white image is less than the target value, and the chromaticity of the white image is yellowish if the chromaticity of the white image is greater than the target value.

In some embodiments, the step of adjusting the thickness of the liquid crystal layer corresponding to the blue pixels if the chromaticity of the white image deviates from the target value comprises:

reducing the thickness of the liquid crystal layer corresponding to the blue pixels if the chromaticity of the white image is less than the target value.

In some embodiments, reducing the thickness of the liquid crystal layer corresponding to the blue pixels comprises:

increasing a thickness of a blue photoresist layer to reduce the thickness of the liquid crystal layer corresponding to the blue pixels.

In some embodiments, the step of adjusting the thickness of the liquid crystal layer corresponding to the blue pixels if the chromaticity of the white image deviates from the target value comprises:

increasing the thickness of the liquid crystal layer corresponding to the blue pixels if the chromaticity of the white image is greater than the target value.

In some embodiments, increasing the thickness of the liquid crystal layer corresponding to the blue pixels comprises:

reducing a thickness of a blue photoresist layer to increase the thickness of the liquid crystal layer corresponding to the blue pixels.

In some embodiments, if the chromaticity of the white image deviates from the target value, the method further comprises:

adjusting a positive polarity voltage and a negative polarity voltage, so that a difference between a positive polarity driving voltage and a negative polarity driving voltage is 12V or less.

In some embodiments, the step of adjusting the thickness of the liquid crystal layer corresponding to the blue pixels to make the chromaticity of the white image conform to the target value comprises:

adjusting the thickness and a gray scale parameter of the liquid crystal layer corresponding to the blue pixels to make the chromaticity of the white image conform to the target value.

In some embodiments, adjusting the gray scale parameter comprises:

reducing a gray scale of blue pixels if the chromaticity of the white image is less than the target value; and reducing a gray scale of red pixels and/or green pixels if the chromaticity of the white image is greater than the target value.

The present invention provides a chromaticity adjustment device, comprising:

an acquiring unit configured to obtain a chromaticity of a white image of a display panel;

a determining unit configured to determine whether the chromaticity of the white image deviates from a target value; and an adjusting unit configured to adjust a thickness of a liquid crystal layer corresponding to blue pixels when the chromaticity of the white image deviates from the target value, so as to make the chromaticity of the white image conform to the target value.

In some embodiments, the determining unit comprises:

a comparison subunit configured to compare the chromaticity of the white image with the target value; and a determining subunit configured to determine whether the chromaticity of the white image is greater than or less than the target value, wherein the chromaticity of the white image is bluish if the chromaticity of the white image is less than the target value, and the chromaticity of the white image is yellowish if the chromaticity of the white image is greater than the target value.

In some embodiments, the adjusting unit is configured to adjust the thickness of the liquid crystal layer corresponding to the blue pixels if the chromaticity of the white image deviates from the target value, and the adjusting unit is configured to reduce the thickness of the liquid crystal layer corresponding to the blue pixels if the chromaticity of the white image is less than the target value.

In some embodiments, reducing the thickness of the liquid crystal layer corresponding to the blue pixels comprises:

increasing a thickness of a blue photoresist layer to reduce the thickness of the liquid crystal layer corresponding to the blue pixels.

In some embodiments, the adjusting unit is configured to adjust the thickness of the liquid crystal layer corresponding to the blue pixels if the chromaticity of the white image deviates from the target value, and the adjusting unit is configured to increase the thickness of the liquid crystal layer corresponding to the blue pixels if the chromaticity of the white image is greater than the target value.

In some embodiments, increasing the thickness of the liquid crystal layer corresponding to the blue pixels comprises:

reducing a thickness of a blue photoresist layer to increase the thickness of the liquid crystal layer corresponding to the blue pixels.

In some embodiments, adjusting a positive polarity voltage and a negative polarity voltage, so that a difference between a positive polarity driving voltage and a negative polarity driving voltage is 12V or less.

In some embodiments, the adjusting unit is configured to adjust the thickness and a gray scale parameter of the liquid crystal layer corresponding to the blue pixels to make the chromaticity of the white image conform to the target value.

In some embodiments, the adjusting unit is configured to adjust the gray scale parameter to reduce the gray scale of blue pixels if the chromaticity of the white image is less than the target value, and to reduce a gray scale of red pixels and/or green pixels if the chromaticity of the white image is greater than the target value.

The present invention provides a display panel, comprising an array substrate, a substrate, a photoresist layer, and a liquid crystal layer, wherein the substrate is disposed opposite to the array substrate, the photoresist layer is disposed on a side of the substrate close to the array substrate, the photoresist layer comprises a blue photoresist layer, a red photoresist layer and a green photoresist layer, the liquid crystal layer is disposed between the array substrate and the substrate, the liquid crystal layer comprises a liquid crystal layer corresponding to blue pixels, a liquid crystal layer corresponding to red pixels and a liquid crystal layer corresponding to green pixels, the liquid crystal layer corresponding to the blue pixels is disposed corresponding to the blue photoresist layer, the liquid crystal layer corresponding to the red pixels is disposed corresponding to the red photoresist layer, and the liquid crystal layer corresponding to the green pixels is disposed corresponding to the green photoresist layer, wherein a thickness of the liquid crystal layer corresponding to the blue pixels is adjusted to be greater than or less than a thickness of the liquid crystal layer corresponding to the red pixels and a thickness of the liquid crystal layer corresponding to the green pixels, so that the chromaticity of the white image conforms to a target value.

In some embodiments, the thickness of the blue photoresist layer is greater than or less than the thickness of the red photoresist layer and the thickness of the green photoresist layer.

The present invention provides a chromaticity adjustment method, a chromaticity adjustment device, and a display panel. The chromaticity adjustment method comprises steps of: obtaining a chromaticity of a white image of a display panel; determining whether the chromaticity of the white image deviates from a target value; adjusting a thickness of a liquid crystal layer corresponding to blue pixels if the chromaticity of the white image deviates from the target value; and making the chromaticity of the white image conform to the target value by adjusting the thickness of the liquid crystal layer corresponding to the blue pixels. Therefore, the chromaticity deviation in the display panel can be relieved. In addition, after adjusting the thickness of the blue photoresist layer, the adjustment range of the gray scale of the blue sub-pixels (B) can be reduced. While improving chromaticity, the impact on light transmittance rate can also be reduced, and the color interference can be prevented.

BRIEF DESCRIPTION OF THE SEVERAL VIEWS OF THE DRAWINGS

In order to explain the technical solutions in the present invention more clearly, the following will introduce briefly the drawings used in the description of the embodiments. Obviously, the drawings in the following description are merely several embodiments of the present invention. For those skilled in the art, other drawings can be obtained based on these drawings without creative work.

DESCRIPTION OF SPECIFIC EMBODIMENTS OF THE INVENTION

The technical solutions of the present invention will be described clearly and completely hereinafter with reference to the accompanying drawings. It is apparent that the described embodiments are only a part of embodiments of the present invention, not all the embodiments. All other embodiments obtained by those skilled in the art based on the embodiments of the present invention belong to the protecting scope of the present invention.

In the embodiments of the present invention, it should be understood that terms such as "comprising" or "having" are intended to indicate the existence of the features, numbers, steps, actions, components, parts, or combinations thereof disclosed in this specification, and are not intended to exclude the possibility that one or more other features, numbers, steps, actions, components, parts or combinations thereof exist or be added.

The present invention provides a chromaticity adjustment method, which will be described in detail below.

Figure 1:
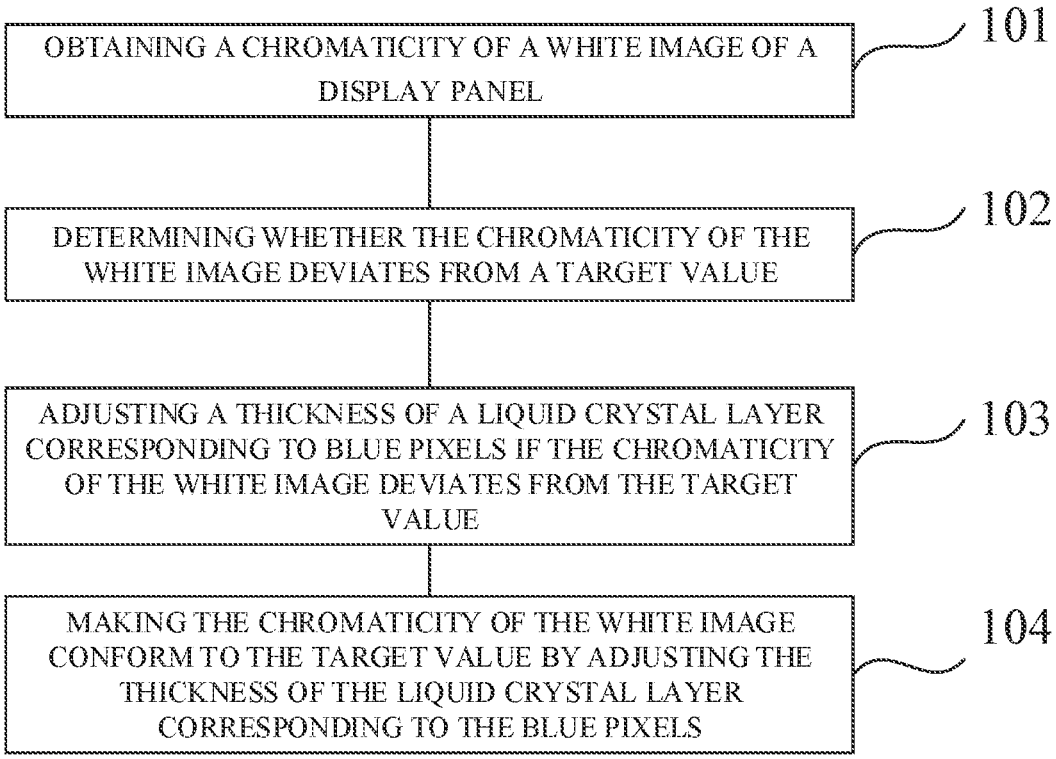
FIG. 1 is a schematic flowchart of a chromaticity adjustment method in accordance with the present invention.

Referring to FIG. 1, FIG. 1 is a schematic flowchart of a chromaticity adjustment method in accordance with the present invention. The present invention provides a chromaticity adjustment method, comprising steps of:

Step 101, obtaining a chromaticity of a white image of a display panel.

It should be noted that color is represented by both brightness and chromaticity. Chromaticity is the property of color that does not include brightness, and it reflects the hue and saturation of a color.

Therefore, obtaining the chromaticity of the white image of the display panel can specifically be obtaining the color of a certain color dot in the image when the image of the display panel is white, and then substituting the color of the color dot into a CIE 1931 color coordinate to obtain the current chromaticity coordinates of the white image.

The CIE 1931 color coordinate establishes three imaginary standard primary colors: red (x), green (y), blue (z), where x+y+z=1. Therefore, a unique color can be determined when the values of x and y are given. The CIE 1931 color coordinate is a practical application tool of colorimetry. In the color gamut diagram determined by the CIE 1931 color coordinate, red is getting purer and purer along the positive direction of an x-axis, green is getting purer and purer along the positive direction of a y-axis, and the purest blue is located near the origin of the coordinate. Therefore, when the display panel displays pure red, the x of the chromaticity value is the biggest. When the pure green is displayed, the y of the chromaticity value is the biggest. When the pure blue is displayed, the value (1-x-y) of the chromaticity is the biggest.

Step 102, determining whether the chromaticity of the white image deviates from a target value.

It should be noted that the target value can be understood as the chromaticity value (x, y) of pure white displayed by a color dot in the display panel when the white image is displayed. The target value is within a white light area of the CIE 1931 color coordinate. Different values in the white light area can be selected as the target value according to the display requirements of different display panels, so as to calibrate the chromaticity of the white image of the display panel. For example, the target value is set to (x=0.3, y=0.3), if the chromaticity value of a certain color dot of the white image is greater than (x=0.3, y=0.3), the chromaticity of the white image is considered to be bluish. If the chromaticity value of a certain color dot of the white image is less than (x=0.3, y=0.3), the chromaticity of the white image is considered to be yellowish. The above values are only examples, which are used to facilitate the description of the concept of the target value, and are not intended to limit the present invention.

In some embodiments, the step of determining whether the chromaticity of the white image deviates from the target value specifically comprises steps of:

Step 1021, comparing the chromaticity of the white image with the target value.

It should be noted that the obtained chromaticity value of the white image is compared with specific size of the target value. For example, the target value is set to (x=0.3, y=0.3), if the obtained chromaticity value of the white image is (x=0.2, y=0.2), the chromaticity of the white image is bluish. If the obtained chromaticity value of the white image is (x=0.5, y=0.4), the chromaticity of the white image is yellowish. The above values are only examples, which are used to facilitate the description of how to compare the chromaticity of the white image with the target value, and are not intended to limit the present invention.

Step 1022, determining whether the chromaticity of the white image is greater than or less than the target value, wherein the chromaticity of the white image is bluish if the chromaticity of the white image is less than the target value, and the chromaticity of the white image is yellowish if the chromaticity of the white image is greater than the target value.

Generally, in the LCD panel, a thickness of a red photoresist layer is the same as a thickness of a green photoresist layer. The intensity of red light and green light are similar, and the yellow light produced by mixing red light and green light will not produce a color deviation. The mixing of blue light and yellow light can produce white light. Therefore, when the chromaticity of the white image is greater than the chromaticity target value, the chromaticity of the white image will be yellowish due to insufficient mixed blue light. When the chromaticity of the white image is less than the target value, the chromaticity of the white image will be bluish due to strong mixed blue light.

Step 103, adjusting a thickness of a liquid crystal layer corresponding to blue pixels if the chromaticity of the white image deviates from the target value.

The thickness of the liquid crystal layer corresponding to the blue pixels is reduced if the chromaticity of the white image is less than the target value. The thickness of the liquid crystal layer corresponding to the blue pixels is increased if the chromaticity of the white image is greater than the target value. Specifically, the thickness of the liquid crystal layer corresponding to the blue pixels can be adjusted by adjusting a thickness of a blue photoresist layer. In one embodiment, if the chromaticity of the white image is less than the target value, the thickness of the blue photoresist layer is increased. If the chromaticity of the white image is greater than the target value, the thickness of the blue photoresist layer is reduced.

The thickness of the blue photoresist layer can be increased by any process of coating, deposition, ink-jet printing, or evaporation when it needs to be increased. For example, ink-jet printing can be used to increase the thickness of the blue photoresist layer. Since only the thickness of the blue photoresist layer needs to be increased, the ink-jet printing method can prevent impact on the photoresist layer of other colors, which can save materials and costs. Using ink-jet printing technology to thicken the blue photoresist layer can also reduce the manufacturing process, reduce production costs, and speed up production efficiency. The thickness of the blue photoresist layer can be thinned by chemical etching or photolithography when it needs to be reduced. For example, a photolithography method can be used. Compared with a chemical etching method, the possible influence of chemical agents on the blue photoresist layer can be prevented.

It should be noted that adjusting the thickness of the photoresist layer to adjust the thickness of the liquid crystal layer is one of many ways, and adjusting the thickness of the liquid crystal layer also comprises other embodiments. The method of adjusting the thickness of the photoresist layer provided in the embodiments of the present invention is not a limitation to the present invention.

As mentioned above, generally, in the LCD panel, the thickness of the red photoresist layer is the same as the thickness of the green photoresist layer. The intensity of red light and green light are similar, and the yellow light produced by mixing red light and green light will not produce a color deviation. The mixing of blue light and yellow light can produce white light. Therefore, when the chromaticity of the white image is less than the target value, the white image appears bluish. At this time, increasing the thickness of the blue photoresist layer can reduce the thickness of the liquid crystal layer corresponding to blue pixels. The transmittance of the backlight through the liquid crystal layer corresponding to blue pixels will be reduced, which can reduce the brightness of the blue light, thereby improving the bluish chromaticity of the white light obtained by mixing blue and yellow light. The same is true for reducing the thickness of the blue photoresist layer if the chromaticity of the white image is greater than the target value, which will not be repeated here.

In some embodiments, if the chromaticity of the white image deviates from the target value, the method further comprises: adjusting a positive polarity voltage and a negative polarity voltage, so that a difference between a positive polarity driving voltage and a negative polarity driving voltage is 12V or less.

Combined with the actual product voltage setting, in some LCD panels, when the pixel gray level of red sub-pixels (R), green sub-pixels (G), and blue sub-pixels (B) is 255, the difference between a positive polarity driving voltage and a negative polarity driving voltage is 13V. Taking increasing the thickness of the blue photoresist layer when the white image is bluish as an example, the experiments show that before increasing the thickness of the blue photoresist layer and after increasing the thickness of the blue photoresist layer by 0.2 μm, chromaticity value x and chromaticity value y measured under two experimental conditions intersects when the difference between the positive driving voltage and the negative driving voltage is 12V. That is, when the difference between the positive driving voltage and negative driving voltage is 12V or less, increasing the thickness of the blue photoresist layer can increase the chromaticity value, and when the difference between the positive driving voltage and negative driving voltage is 12V or more, increasing the blue photoresist layer cannot increase the chromaticity value. Therefore, by adjusting the difference between the positive polarity driving voltage and the negative polarity driving voltage to be 12V or less, the thickness of the liquid crystal layer corresponding to the blue pixels can be adjusted to make the chromaticity of the white image conform to the target value.

In some embodiments, the step of adjusting the thickness of the liquid crystal layer corresponding to the blue pixels to make the chromaticity of the white image conform to the target value comprises step of: adjusting the thickness and a gray scale parameter of the liquid crystal layer corresponding to the blue pixels to make the chromaticity of the white image conform to the target value.

The gray scale refers to a hue level of the intensity of the electromagnetic wave radiation of a ground feature represented in the black and white image, it is the scale to divide the spectrum characteristics of the ground features. The display panel comprises a plurality of pixels, and each pixel comprises a red sub-pixel (R), a green sub-pixel (G), and a blue sub-pixel (B). When the gray scale values of the red sub-pixel (R), green sub-pixel (G), and blue sub-pixel (B) are all 0, the image displayed by the display panel is black. When the gray scale values of the red sub-pixel (R), green sub-pixel (G), and blue sub-pixel (B) are all 255, the image displayed by the display panel is white.

Moreover, adjusting the gray scale parameter comprises:

Step 1031, reducing a gray scale of blue pixels if the chromaticity of the white image is less than the target value.

In one embodiment, the gray level values of the red sub-pixel (R) and the green sub-pixel (G) are set to 255, and the gray level value of the blue sub-pixel (B) is adjusted from 255 to 200 in sequence, and then the chromaticity values corresponding to the white image under different combinations of gray scale values are calculated.

Figure 2:
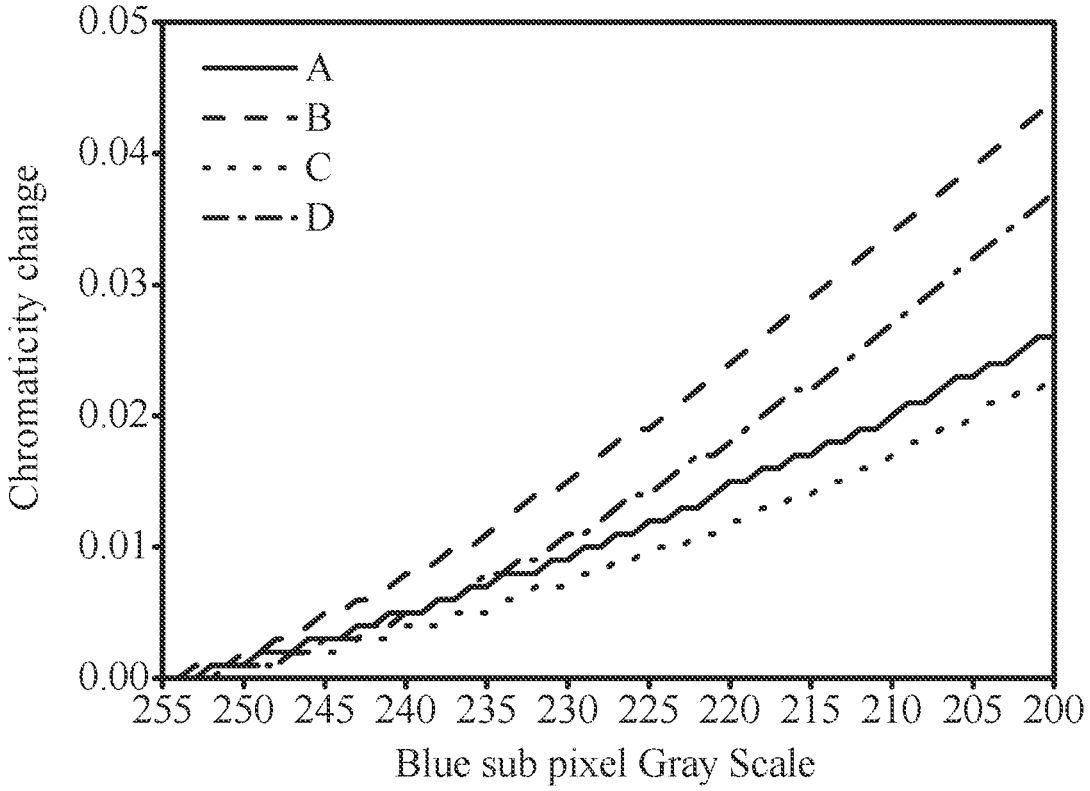
FIG. 2 is a diagram of a chromaticity change obtained by degrading blue sub-pixels (B) in accordance with the present invention.

Referring to FIG. 2, FIG. 2 is a diagram of a chromaticity change obtained by degrading the blue sub-pixels (B) in accordance with the present invention. In FIG. 2, the abscissa is a blue sub-pixel gray scale value, and the ordinate is a chromaticity change value (Δx or Δy) of a white image. Line A is the Δy value when the thickness of the liquid crystal layer corresponding to blue pixels is reduced by 0.2 μm, line B is the Δx value when the thickness of the liquid crystal layer corresponding to blue pixels is reduced by 0.2 μm, line C is the Δx value of the thickness of the original liquid crystal layer corresponding to blue pixels, and D is the Δy value of the thickness of the original liquid crystal layer corresponding to blue pixels. As can be seen from FIG. 2, after the thickness of the liquid crystal layer corresponding to blue pixels is reduced by 0.2 μm, compared with the thickness of the liquid crystal layer corresponding to blue pixels not reduced by 0.2 μm, a same chromaticity change can be obtained under a smaller degrading range of the blue sub-pixel (B). When the chromaticity changes Δy are 0.01, 0.02, and 0.03, respectively, after the thickness of the liquid crystal layer corresponding to blue pixels is reduced by 0.2 μm, compared with the thickness of the liquid crystal layer corresponding to blue pixels not reduced by 0.2 μm, the gray level changes of the blue sub-pixel (B) are reduced by level 5, level 6, and level 7, respectively.

It should be noted that the thickness of the liquid crystal layer can also be referred as a cell gap, which can be understood as a distance from an array substrate to a photoresist layer. Therefore, the aforementioned reduction in the thickness of the liquid crystal layer corresponding to blue pixels can be achieved by increasing the thickness of the blue photoresist layer. For example, if the thickness of the blue photoresist layer is increased by 0.2 μm, the thickness of the liquid crystal layer corresponding to blue pixels is reduced by 0.2 μm. Moreover, degradation refers to reduce the gray scale value.

Figure 3:
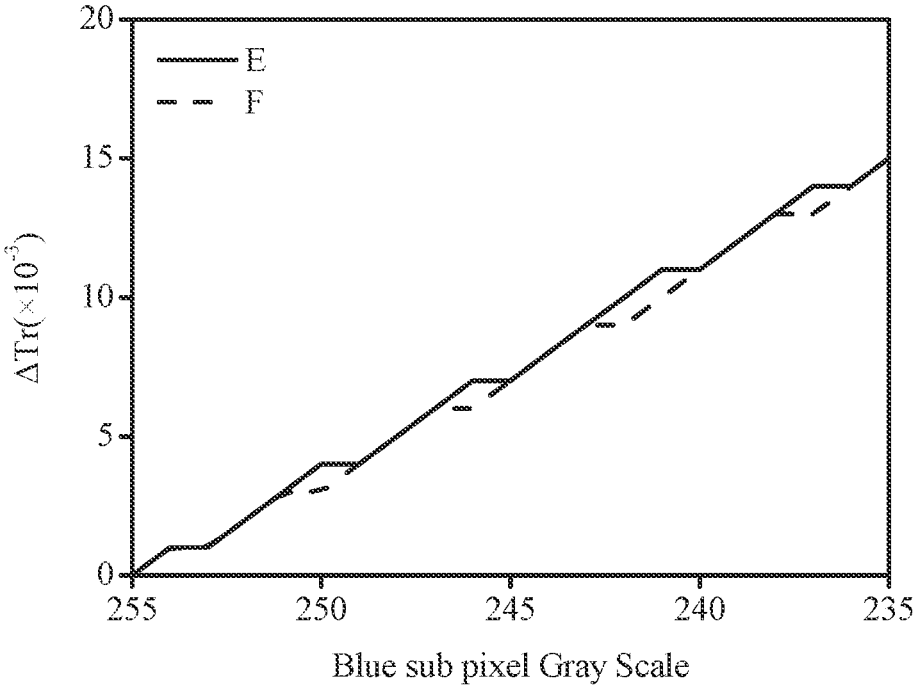
FIG. 3 is a diagram of a light transmittance rate (Tr) change obtained by degrading the blue sub-pixels (B) in accordance with the present invention.

Referring to FIG. 3, FIG. 3 is a diagram of a light transmittance rate (Tr) change obtained by degrading the blue sub-pixels (B) in accordance with the present invention. In order to show the light transmittance rate (Tr) change results more clearly, FIG. 3 only shows the light transmittance (Tr) change results of the blue sub-pixel (B) from 255 to 235. In FIG. 3, the abscissa is a blue sub-pixel gray scale value, and the ordinate is a light transmittance rate (Tr) change value (ΔTr), where line E is the ΔTr value when the thickness of the liquid crystal layer corresponding to blue pixels is reduced by 0.2 μm, and line F is the ΔTr value of the original liquid crystal layer corresponding to blue pixels. After the thickness of the liquid crystal layer corresponding to blue pixels was reduced by 0.2 μm, the ΔTr value became smaller than that of the liquid crystal layer corresponding to blue pixels without a reduction of 0.2 μm. When the chromaticity changes (Δy) are 0.01, 0.02, and 0.03, respectively, after the thickness of the liquid crystal layer corresponding to blue pixels is reduced by 0.2 μm, compared with the thickness of the liquid crystal layer corresponding to blue pixels not reduced by 0.2 μm, the ΔTr value (that is, the magnitude of the decrease of the Tr value) is smaller by 0.4%, 0.5% and 0.6%, respectively.

As can be seen from the above experimental results, the present invention reduces the thickness of the liquid crystal layer corresponding to blue pixels, which can effectively reduce the adjustment range of the gray scale of the blue sub-pixels (B) and can effectively increase the light transmittance rate (Tr), thereby increasing the brightness of the LCD panel. In addition, the greater the chromaticity needs to be improved, the greater the reduction in the adjustment range of the gray scale of the blue sub-pixels, and the greater the increase in the light transmittance rate (Tr).

Step 1032, reducing a gray scale of red pixels and/or green pixels if the chromaticity of the white image is greater than the target value.

If the chromaticity of the white image is greater than the target value, the white image is yellowish, thus reducing a gray scale of red pixels and/or green pixels can reduce the brightness of red and/or green light, and the brightness of the yellow light obtained by mixing red and green light is reduced. Thus the chromaticity of the white light obtained by mixing blue light with yellow light will be improved. The gray scale of the red pixels, the gray scale of the green pixels, or both of them can be adjusted according to the obtained chromaticity value of the white image. The specific experiments and results are the same, which will not be repeated here.

Step 104, making the chromaticity of the white image conform to the target value by adjusting the thickness of the liquid crystal layer corresponding to the blue pixels.

It should be noted that some LCD panels set the thickness of the red photoresist layer and the green photoresist layer to 2.3 μm, the thickness of the liquid crystal layer corresponding to the red pixels and the liquid crystal layer corresponding to the green pixels is 3.3 μm accordingly. The thickness of the blue photoresist layer is set to 2.5 μm, the thickness of the liquid crystal layer corresponding to the blue pixels is 3.1 μm accordingly. The thickness of the liquid crystal layer corresponding to the blue pixels is less than the thickness of the liquid crystal layer corresponding to the red pixels and the liquid crystal layer corresponding to the green pixels due to the consideration of brightness, viewing angle, and other factors in the panel design.

In an embodiment of the present invention, an experiment was conducted on an LCD panel corresponding to the above-mentioned parameters. Based on the comparison of the chromaticity of the white image with the target value, when it is determined that the chromaticity of the white image is less than the target value (that is, the white image is bluish), the thickness of the liquid crystal layer corresponding to the blue pixels is reduced. Specifically, the thickness of the red photoresist layer, the green photoresist layer, and the corresponding thickness of the liquid crystal layer corresponding to the red pixels and the liquid crystal layer corresponding to the green pixels are unchanged, while the thickness of the blue photoresist layer is set to 2.7 μm, and the thickness of the liquid crystal layer corresponding to the blue pixels is 2.9 μm accordingly. Experimental results show that when the thickness of the blue photoresist layer is greater than the thickness of the red photoresist layer or the green photoresist layer, the chromaticity x and the chromaticity y can be effectively improved, thereby improving the problem of blueish chromaticity of the white image.

Due to different display panels, the thickness of the photoresist layer is set differently. Therefore, in an embodiment provided by the present invention, when the chromaticity of the white image is less than the target value, it is only necessary to adjust the thickness of the blue photoresist layer to be greater than that of the red photoresist layer or green photoresist layer. Furthermore, a difference between the thickness of the blue photoresist layer and the red photoresist layer or the green photoresist layer is 0.3 μm or more. The situation that the chromaticity of the white image is greater than the target value will not be repeated here.

Figure 4:
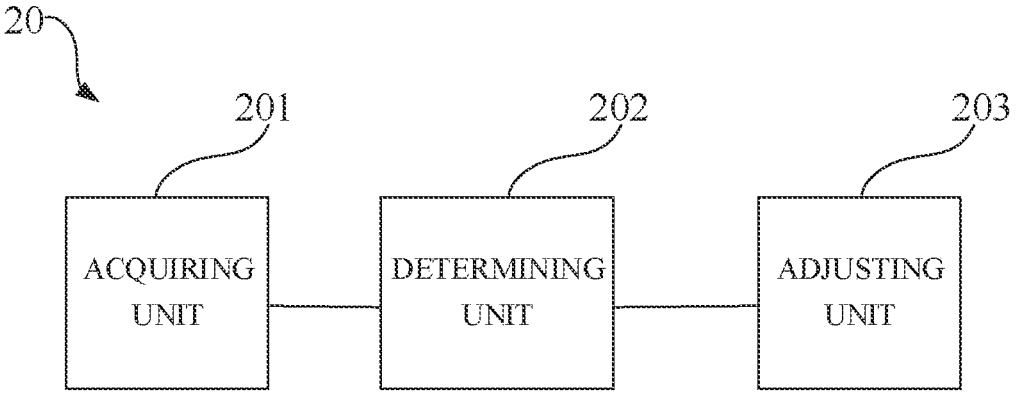
FIG. 4 is a schematic diagram of a first structure of a chromaticity adjustment device in accordance with the present invention.

The present invention further provides a chromaticity adjustment device 20. Referring to FIG. 4, FIG. 4 is a schematic diagram of a first structure of the chromaticity adjustment device 20 in accordance with the present invention. The chromaticity adjustment device 20 comprises an acquiring unit 201, a determining unit 202, and an adjusting unit 203. The acquiring unit 201 is configured to obtain a chromaticity of a white image of a display panel. The determining unit 202 is configured to determine whether the chromaticity of the white image deviates from a target value. The adjusting unit 203 is configured to adjust a thickness of a liquid crystal layer corresponding to blue pixels when the chromaticity of the white image deviates from the target value, so as to make the chromaticity of the white image conform to the target value.

In some embodiments, the adjusting unit 203 is configured to adjust the thickness of the liquid crystal layer corresponding to the blue pixels if the chromaticity of the white image deviates from the target value, and the adjusting unit is configured to reduce the thickness of the liquid crystal layer corresponding to the blue pixels if the chromaticity of the white image is less than the target value. Specifically, if the chromaticity of the white image is less than the target value, the thickness of the blue photoresist layer is increased. If the chromaticity of the white image is greater than the target value, the thickness of the liquid crystal layer corresponding to the blue pixels is increased. Specifically, if the chromaticity of the white image is greater than the target value, the thickness of the blue photoresist layer is reduced.

The adjusting unit 203 is configured to adjust a positive polarity voltage and a negative polarity voltage, so that a difference between a positive polarity driving voltage and a negative polarity driving voltage is 12V or less.

The adjusting unit 203 is configured to adjust the thickness and a gray scale parameter of the liquid crystal layer corresponding to the blue pixels to make the chromaticity of the white image conform to the target value.

The adjusting unit 203 is configured to adjust the gray scale parameter to reduce the gray scale of blue pixels if the chromaticity of the white image is less than the target value, and to reduce a gray scale of red pixels and/or green pixels if the chromaticity of the white image is greater than the target value.

Figure 5:
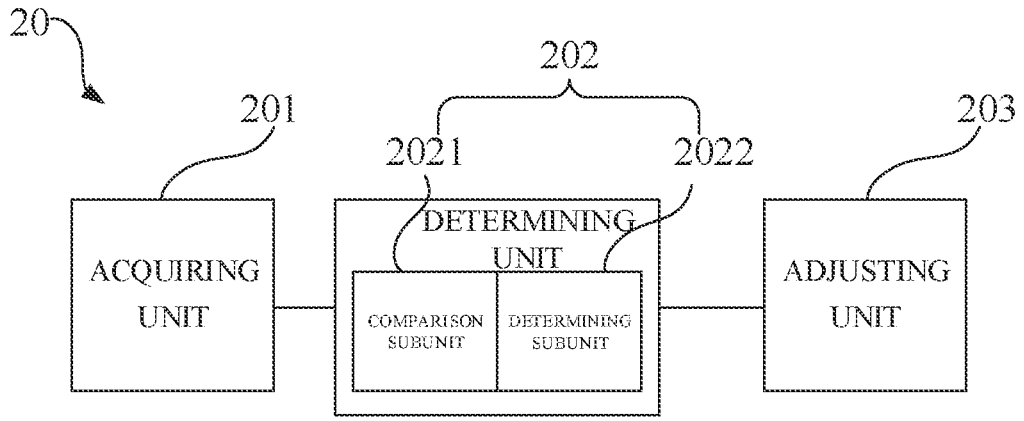
FIG. 5 is a schematic diagram of a second structure of the chromaticity adjustment device in accordance with the present invention.

Referring to FIG. 5, FIG. 5 is a schematic diagram of a second structure of the chromaticity adjustment device 20 in accordance with the present invention. The determining unit 202 comprises a comparison subunit 2021 and a determining subunit 2022. The comparison subunit 2021 is configured to compare the chromaticity of the white image with the target value. The determining subunit 2022 is configured to determine whether the chromaticity of the white image is greater than or less than the target value, wherein the chromaticity of the white image is bluish if the chromaticity of the white image is less than the target value, and the chromaticity of the white image is yellowish if the chromaticity of the white image is greater than the target value.

Figure 6:
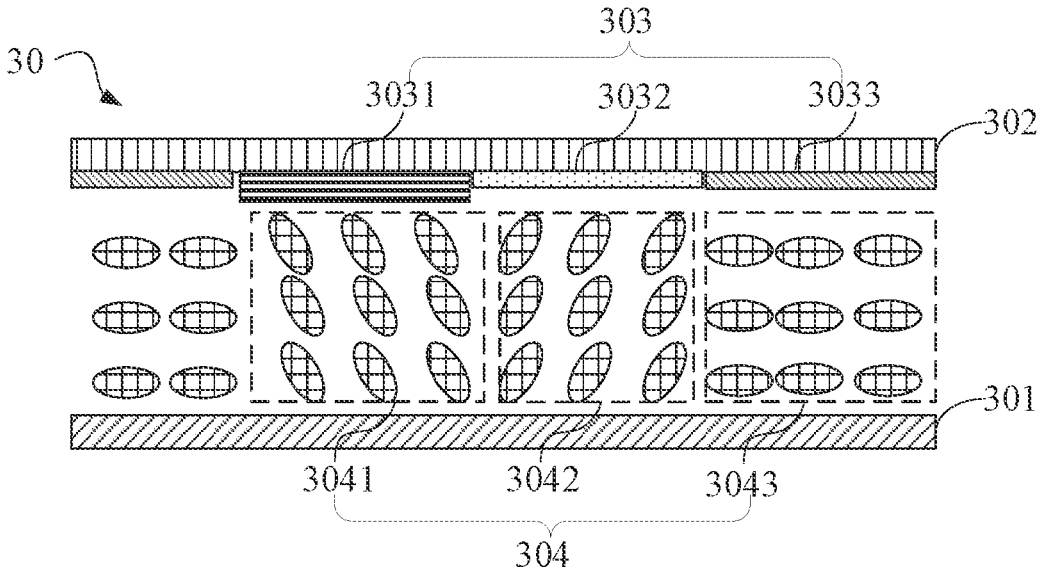
FIG. 6 is a schematic structural diagram of a display panel in accordance with the present invention.

The present invention further provides a display panel 30, FIG. 6 is a schematic structural diagram of a display panel 30 in accordance with the present invention. The display panel 30 comprises an array substrate 301, a substrate 302, a photoresist layer 303, and a liquid crystal layer 304. The substrate 302 is disposed opposite to the array substrate 301. The photoresist layer 303 is disposed on a side of the substrate 302 close to the array substrate 301, the photoresist layer 303 comprises a blue photoresist layer 3031, a red photoresist layer 3032, and a green photoresist layer 3033. The liquid crystal layer 304 is disposed between the array substrate 301 and the substrate 302, the liquid crystal layer 304 comprises a liquid crystal layer corresponding to blue pixels 3041, a liquid crystal layer corresponding to red pixels 3042, and a liquid crystal layer corresponding to green pixels 3043, the liquid crystal layer corresponding to the blue pixels 3041 is disposed corresponding to the blue photoresist layer 3031, the liquid crystal layer corresponding to the red pixels 3042 is disposed corresponding to the red photoresist layer 3032, and the liquid crystal layer corresponding to the green pixels 3043 is disposed corresponding to the green photoresist layer 3033. A thickness of the liquid crystal layer corresponding to the blue pixels 3041 is greater than or less than a thickness of the liquid crystal layer corresponding to the red pixels 3042 and a thickness of the liquid crystal layer 3043. The display panel 30 adjusts the chromaticity of the display panel 30 by the chromaticity adjustment device 20, and the display panel 30 performs chromaticity adjustment using the above chromaticity adjustment method.

It should be noted that the arrangement sequence of the blue photoresist layer 3031, the red photoresist layer 3032, and the green photoresist layer 3033, as well as a deflection condition of the liquid crystal layer 304 in the display panel 30 shown in FIG. 6 are only examples, and are not intended to limit the present invention.

In one embodiments, the thickness of the blue photoresist layer 3031 is greater than or less than the thickness of the red photoresist layer 3032 and the thickness of the green photoresist layer 3033.

In one embodiment, when the chromaticity of the white image is less than the target value, the chromaticity of the white image is bluish, so the thickness of the blue photoresist layer 3031 is increased, and the thickness of the blue photoresist layer 3031 is greater than the thickness of the red photoresist layer 3032 and the thickness of the green photoresist layer 3033. When the chromaticity of the white image is greater than the target value, the chromaticity of the white image is yellowish, so the thickness of the blue photoresist layer 3031 is reduced, and the thickness of the blue photoresist layer 3031 is less than the thickness of the red photoresist layer 3032 and the thickness of the green photoresist layer 3033. The display panel 30 may also comprise other devices. Other devices and their assembly in the present invention are related technologies well known to those skilled in the art, and will not be repeated here.

In order to solve the problem of the chromaticity deviation of the image of the display panel 30, the display panel 30 proposed in the present invention performs chromaticity adjustment by adjusting the thickness of the liquid crystal layer corresponding to blue pixels. When the white image is yellowish, the thickness of the blue photoresist layer 3031 is reduced, so the transmittance rate of the light source at the blue sub-pixels (B) electrode can be increased, thereby increasing the brightness of blue light. In this way, the blue light can be mixed with the excess yellow light to form white light. Therefore, the problem of yellowish LCD images can be solved. In the same way, when the white image is bluish, increasing the thickness of the blue photoresist layer 3031 can solve the problem of the bluish LCD images. Therefore, the problem of chromaticity deviation of the white image of the display panel is effectively solved, and the image quality of the display panel is improved. While adjusting the thickness of the blue photoresist layer 3031, the gray scale of the blue sub-pixels (B) can be adjusted. After adjusting the thickness of the blue photoresist layer 3031, the degrading range of the blue sub-pixels (B) does not need to be too large in order to make the color dot reach the target value. In addition, the influence on Tr can be reduced, and the problems of uneven display brightness and color interference of the display panel 30 can be relieved.

It should be noted that in FIG. 6, adjusting the thickness of the blue photoresist layer 3031 is taken as an example for description, and adjusting the thickness of the liquid crystal layer corresponding to blue pixels also comprises other embodiments, and FIG. 6 is not a limitation of the present invention.

The chromaticity adjustment method, the chromaticity adjustment device, and the display panel provided in the embodiments of the present invention are described in detail above. The principle and implementations of the present invention are described in this specification by using specific examples. The description about the foregoing embodiments is merely provided to help understand the present invention. In addition, those skilled in the art can make modifications in terms of the specific implementations and application scopes according to the ideas of the present invention. Therefore, the content of this specification shall not be construed as a limit to the present invention.

What is claimed is:

1. A chromaticity adjustment method, comprising steps of:

obtaining a chromaticity of a white image of a display panel;

determining whether the chromaticity of the white image deviates from a target value;

adjusting a thickness of a liquid crystal layer corresponding to blue pixels when the chromaticity of the white image deviates from the target value; and making the chromaticity of the white image conform to the target value by adjusting the thickness of the liquid crystal layer corresponding to the blue pixels;

wherein the step of adjusting the thickness of the liquid crystal layer corresponding to the blue pixels to make the chromaticity of the white image conform to the target value comprises:

adjusting the thickness and a gray scale parameter of the liquid crystal layer corresponding to the blue pixels to make the chromaticity of the white image conform to the target value; and wherein adjusting the gray scale parameter comprises:

reducing a gray scale of the blue pixels when the chromaticity of the white image is less than the target value; and reducing a gray scale of red pixels and/or green pixels when the chromaticity of the white image is greater than the target value.

2. The chromaticity adjustment method as claimed in claim 1, wherein the step of determining whether the chromaticity of the white image deviates from the target value comprises:

comparing the chromaticity of the white image with the target value; and determining whether the chromaticity of the white image is greater than or less than the target value, wherein the chromaticity of the white image is bluish when the chromaticity of the white image is less than the target value, and the chromaticity of the white image is yellowish when the chromaticity of the white image is greater than the target value.

3. The chromaticity adjustment method as claimed in claim 1, wherein the step of adjusting the thickness of the liquid crystal layer corresponding to the blue pixels when the chromaticity of the white image deviates from the target value comprises:

reducing the thickness of the liquid crystal layer corresponding to the blue pixels when the chromaticity of the white image is less than the target value.

4. The chromaticity adjustment method as claimed in claim 3, wherein reducing the thickness of the liquid crystal layer corresponding to the blue pixels comprises:

increasing a thickness of a blue photoresist layer to reduce the thickness of the liquid crystal layer corresponding to the blue pixels.

5. The chromaticity adjustment method as claimed in claim 1, wherein the step of adjusting the thickness of the liquid crystal layer corresponding to the blue pixels when the chromaticity of the white image deviates from the target value comprises:

increasing the thickness of the liquid crystal layer corresponding to the blue pixels when the chromaticity of the white image is greater than the target value.

6. The chromaticity adjustment method as claimed in claim 5, wherein increasing the thickness of the liquid crystal layer corresponding to the blue pixels comprises:

reducing a thickness of a blue photoresist layer to increase the thickness of the liquid crystal layer corresponding to the blue pixels.

7. The chromaticity adjustment method as claimed in claim 1, wherein when the chromaticity of the white image deviates from the target value, the method further comprises:

adjusting a positive polarity voltage and a negative polarity voltage, so that a difference between a positive polarity driving voltage and a negative polarity driving voltage is 12V or less.

8. A chromaticity adjustment device, comprising:

an acquiring circuit configured to obtain a chromaticity of a white image of a display panel;

a determining circuit configured to determine whether the chromaticity of the white image deviates from a target value; and an adjusting circuit configured to adjust a thickness of a liquid crystal layer corresponding to blue pixels when the chromaticity of the white image deviates from the target value, so as to make the chromaticity of the white image conform to the target value;

wherein the adjusting circuit is configured to adjust the thickness and a gray scale parameter of the liquid crystal layer corresponding to the blue pixels to make the chromaticity of the white image conform to the target value; and wherein the adjusting circuit is configured to adjust a gray scale parameter to reduce a gray scale of the blue pixels when the chromaticity of the white image is less than the target value, and to reduce a gray scale of red pixels and/or green pixels when the chromaticity of the white image is greater than the target value.

9. The chromaticity adjustment device as claimed in claim 8, wherein the determining circuit comprises:

a comparison subcircuit configured to compare the chromaticity of the white image with the target value; and a determining subcircuit configured to determine whether the chromaticity of the white image is greater than or less than the target value, wherein the chromaticity of the white image is bluish when the chromaticity of the white image is less than the target value, and the chromaticity of the white image is yellowish when the chromaticity of the white image is greater than the target value.

10. The chromaticity adjustment device as claimed in claim 8, wherein the adjusting circuit is configured to adjust the thickness of the liquid crystal layer corresponding to the blue pixels when the chromaticity of the white image deviates from the target value, and the adjusting circuit is configured to reduce the thickness of the liquid crystal layer corresponding to the blue pixels when the chromaticity of the white image is less than the target value.

11. The chromaticity adjustment device as claimed in claim 10, wherein reducing the thickness of the liquid crystal layer corresponding to the blue pixels comprises:

increasing a thickness of a blue photoresist layer to reduce the thickness of the liquid crystal layer corresponding to the blue pixels.

12. The chromaticity adjustment device as claimed in claim 8, wherein the adjusting circuit is configured to adjust the thickness of the liquid crystal layer corresponding to the blue pixels when the chromaticity of the white image deviates from the target value, and the adjusting circuit is configured to increase the thickness of the liquid crystal layer corresponding to the blue pixels when the chromaticity of the white image is greater than the target value.

13. The chromaticity adjustment device as claimed in claim 12, wherein increasing the thickness of the liquid crystal layer corresponding to the blue pixels comprises:

reducing a thickness of a blue photoresist layer to increase the thickness of the liquid crystal layer corresponding to the blue pixels.

14. The chromaticity adjustment device as claimed in claim 8, wherein the adjusting circuit is configured to adjust a positive polarity voltage and a negative polarity voltage, so that a difference between a positive polarity driving voltage and a negative polarity driving voltage is 12V or less.

* * * * *